US010096322B2

(12) United States Patent
Lecomte et al.

(10) Patent No.: US 10,096,322 B2
(45) Date of Patent: Oct. 9, 2018

(54) AUDIO DECODER HAVING A BANDWIDTH EXTENSION MODULE WITH AN ENERGY ADJUSTING MODULE

(71) Applicant: Fraunhofer-Gesellschaft zur Foerderung der angewandten Forschung e.V., Munich (DE)

(72) Inventors: Jérémie Lecomte, Fuerth (DE); Fabian Bauer, Erlangen (DE); Ralph Sperschneider, Ebermannstadt (DE); Arthur Tritthart, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/974,253

(22) Filed: Dec. 18, 2015

(65) Prior Publication Data

US 2016/0180854 A1 Jun. 23, 2016

Related U.S. Application Data

(63) Continuation of application No. PCT/EP2014/062902, filed on Jun. 18, 2014.

(30) Foreign Application Priority Data

Jun. 21, 2013 (EP) ..... 13173152
May 5, 2014 (EP) ..... 14167050

(51) Int. Cl.
*G10L 19/00* (2013.01)
*G10L 21/00* (2013.01)
(Continued)

(52) U.S. Cl.
CPC ..... *G10L 19/005* (2013.01); *G10L 19/0204* (2013.01); *G10L 19/028* (2013.01);
(Continued)

(58) Field of Classification Search
None
See application file for complete search history.

(56) References Cited

U.S. PATENT DOCUMENTS 6,009,117 A * 12/1999 Yamamura ..... H04B 1/707 375/141
7,693,710 B2 4/2010 Jelinek et al.
(Continued)

FOREIGN PATENT DOCUMENTS

RU 2386179 C2 4/2010
WO 2006107833 A1 10/2006
(Continued)

OTHER PUBLICATIONS

3GPP, "Technical Specification Group Services and System Aspects, Extended adaptive multi-rate-wideband (AMR-WB+) codec", 3GPP TS 26.290, 3rd Generation Partnership Project, 2009, 85 pages.
(Continued)

*Primary Examiner* — Fariba Sirjani
(74) *Attorney, Agent, or Firm* — Perkins Coie LLP; Michael A. Glenn

(57) ABSTRACT

An audio decoder configured to produce an audio signal from a bitstream containing audio frames includes: a core band decoding module configured to derive a directly decoded core band audio signal from the bitstream; a bandwidth extension module configured to derive a parametrically de-coded bandwidth extension audio signal from the core band audio signal and from the bitstream, wherein the bandwidth extension audio signal is based on a frequency domain signal having at least one frequency band; and a combiner configured to combine the core band audio signal and the bandwidth extension audio signal so as to produce the audio signal; wherein the bandwidth extension module includes an energy adjusting module being configured in such way that in a current audio frame in which an audio frame loss occurs, an adjusted signal energy for the cur-rent audio frame for the at least one frequency band is set.

15 Claims, 5 Drawing Sheets

(51) Int. Cl.

| | |
|---|---|
| ***G10L 25/00*** | (2013.01) |
| ***G06F 17/00*** | (2006.01) |
| ***G10L 19/005*** | (2013.01) |
| ***G10L 19/24*** | (2013.01) |
| ***G10L 21/038*** | (2013.01) |
| ***G10L 19/02*** | (2013.01) |
| ***G10L 19/028*** | (2013.01) |
| ***G10L 19/083*** | (2013.01) |

(52) U.S. Cl.
CPC ..... *G10L 19/083* (2013.01); *G10L 19/24* (2013.01); *G10L 21/038* (2013.01)

(56) References Cited

U.S. PATENT DOCUMENTS

| | | | | |
|---|---|---|---|---|
| 2003/0048957 | A1* | 3/2003 | Dai | G06T 7/0004 382/260 |
| 2004/0128128 | A1* | 7/2004 | Wang | G10L 19/005 704/229 |
| 2008/0040120 | A1* | 2/2008 | Kurniawati | G10L 19/002 704/500 |
| 2009/0141790 | A1* | 6/2009 | Kawashima | G10L 19/24 375/240 |
| 2009/0198498 | A1* | 8/2009 | Ramabadran | G10L 21/038 704/500 |
| 2010/0286805 | A1* | 11/2010 | Gao | G10L 19/0017 700/94 |
| 2011/0202352 | A1* | 8/2011 | Neuendorf | G10L 19/0208 704/500 |
| 2011/0249835 | A1* | 10/2011 | Lunner | H04R 25/505 381/312 |
| 2012/0016667 | A1* | 1/2012 | Gao | G10L 21/038 704/203 |
| 2012/0328124 | A1* | 12/2012 | Kjoerling | G10L 21/038 381/98 |
| 2013/0151255 | A1 | 6/2013 | Kim et al. | |
| 2014/0019125 | A1* | 1/2014 | Laaksonen | G10L 21/038 704/205 |
| 2015/0162010 | A1* | 6/2015 | Ishikawa | G10L 19/00 704/500 |
| 2016/0180854 | A1* | 6/2016 | Lecomte | G10L 19/24 704/205 |

FOREIGN PATENT DOCUMENTS

| | | | |
|---|---|---|---|
| WO | 2006107834 | A1 | 10/2006 |
| WO | 2006107836 | A1 | 10/2006 |
| WO | 2006107837 | A1 | 10/2006 |
| WO | 2006107838 | A1 | 10/2006 |
| WO | 2006107839 | A2 | 10/2006 |
| WO | 2007000988 | A1 | 1/2007 |
| WO | 2012036487 | A2 | 3/2012 |
| WO | 2012131438 | A1 | 10/2012 |

OTHER PUBLICATIONS

3GPP [3GP12A], "General audio codec audio processing functions; Enhanced aacPlus general audio codec; additional decoder tools (release 11)", 3GPP TS 26.402, 3rd Generation Partnership Project, Sep. 2012.

3GPP [3GP12B], "Speech codec speech processing functions; adaptive multi-rate-wideband (AMRWB) speech codec; error concealment of erroneous or lost frames", 3GPP TS 26.191, 3rd Generation Partnership Project, Sep. 2012.

EBU/ETSI, "Digital radio mondiale (DRM); system specification", ETSI ES 201 980, ETSI, Jun. 2012.

EBU/ETSI, "JTC Broadcast, Digital audio broadcasting (DAB); transport of advanced audio coding (AAC) audio", European Broadcasting Union, May 2010.

ISO/IEC, "Information technology—coding of audio-visual objects—part 3: Audio", ISO/IEC JTC1/SC29/WG11, International Organization for Standardization, 2009, 1178 pages (Broken into 5 parts for this submission).

ITU-T; G.718, "Frame error robust narrow-band and wideband embedded variable bit-rate coding of speech and audio from 8-32 kbit/s", Recommendation ITU-T G.718, Telecommunication Standardization Sector of ITU, Jun. 2008, 257 pages.

Ryu, Sang-Uk et al., "Frame loss concealment for audio decoders employing spectral band replication", Convention Paper 6962, Electrical and Computer Engineering, University of California, Oct. 2006.

Schneider, Andreas et al., "Evaluation of real-time transport protocol configurations using aacplus", Convention paper 6789, AES, May 2006, Presented at the 120th Convention May 20-23, 2006, May 20, 2006.

Kontio, Juho et al., "Neural Network-Based Artificial Bandwidth Expansion of Speech", IEEE Transactions on Audio, Speech, and Language Processing, vol. 15, No. 3, Mar. 2007, 873-881.

* cited by examiner

SBR DECODER

SBR DECODING: GENERATION AND ADJUSTMENT OF SBR SIGNAL
OUT OF CODED ENVELOPE INFORMATION AND CORE CODER SIGNAL

BANDWIDTH EXTENSION IN AMR-WB + DECODER
PRIOR ART

AUDIO DECODER HAVING A BANDWIDTH EXTENSION MODULE WITH AN ENERGY ADJUSTING MODULE

CROSS-REFERENCE TO RELATED APPLICATIONS

This application is a continuation of copending International Application No. PCT/EP2014/062902, filed Jun. 18, 2014, which is incorporated herein by reference in its entirety, and additionally claims priority from European Applications Nos. EP 13173152.3, filed Jun. 21, 2013, and EP 14167050.5, filed May 5, 2014, both of which are incorporated herein by reference in their entirety.

BACKGROUND OF THE INVENTION

SBR (Spectral Band Replication), like other bandwidth extension techniques, is meant to encode and decode spectral high band parts of audio signals on top of a core coder stage. SBR is standardized in [ISO09] and used jointly with AAC in the MPEG-4 Profile HE-AAC, which is employed in various application standards, e.g. 3GPP [3GP12a], DAB+ [EBU10] and DRM [EBU12].

State of the art SBR decoding in conjunction with AAC is described in [ISO09, section 4.6.18].

FIG. 1 illustrates the state of the art SBR decoder which comprises an analysis and a synthesis filterbank, SBR data decoding an HF generator and an HF adjuster:

In the state-of-the-art SBR decoding, the output of the core coder is a low-pass filtered representation of the original signal. It is the input $x_{pcm_in}$ to the QMF analysis filterbank of the SBR decoder.

The output of this filterbank $X_{QMF_ana}$ is handed over to the HF generator, where the patching takes place. Patching basically is a replication of the low-band spectrum up into the high-bands.

The patched spectrum $X_{HF_patched}$ is now given to the HF adjuster, together with the spectral information of the high-bands (envelopes), obtained from the SBR data decoding. Envelope information will be Huffman decoded, then differentially decoded and finally dequantized in order to obtain the envelope data (see FIG. 2). The obtained envelope data is a set of scale factors which covers a certain amount of time, e.g. a full frame or parts of it. The HF adjuster properly adjusts the energies of the patched high-bands in order to match as good as possible with the original high-band energies at encoder side for every band k. Equation 1 and FIG. 2 clarify this:

$$g_{sbr}[k]=E_{Rej}[k]/E_{EstAvg}[I]$$

$$E_{Adj}[k]=E_{Est}[k]\times g_{sbr}[k] \tag{1}$$

where $E_{Rej}[k]$ denotes the energy for one band k, being transmitted in encoded form in the SBR bitstream, $E_{Est}[k]$ denotes the energy from one high-band k, patched by the HF generator;

$E_{EstAvg}[I]$ denotes the averaged high-band energy inside of one scale factor band I, being defined as a range of bands between a start band $k_{start}^{l}$ and a stop band $k_{stop}^{l}$:

$$E_{EstAvg}[I] = \frac{1}{N_l}\sum_{k=k_{start}^{l}}^{k_{stop}^{l}} E_{Est}(k) \tag{2}$$

$E_{AdJ}$ [k] denotes the energy from one high-band k, adjusted by the HF adjuster, using $gain_{sbr}$;

$g_{sbr}[k]$ denotes one gain factor, resulting from the division shown in equation (1).

The Synthesis QMF filterbank decodes the processed QMF samples xHF_adj to PCM audio xpcm_out.

If the reconstructed spectrum has a lack of noise, which was present in the original high-bands but not patched by the HF Generator, there is the possibility to add some additional noise with a certain noise floor Q for each band k.

$$Q[k] = \frac{Energy_{Additional_Noise}[k]}{Energy_{HF_Generated}[k]} \tag{3}$$

Moreover, state of the art SBR allows for moving SBR frame borders within certain limits and multiple envelopes per frame.

SBR decoding in conjunction with CELP/HVXC is described in [EBU12, section 5.6.2.2]. The CELP/HVXC+ SBR decoder in DRM is closely related to state of the art SBR decoding in HEAAC, described in section 1.1.1. Basically, FIG. 1 applies.

Decoding of envelope information is adapted to spectral properties of speech-like signals, as described in [EBU12, section 5.6.2.2.4].

In regular AMR-WB decoding, the high-band excitation is obtained by generating white noise $u_{HB1}(n)$. The power of the high-band excitation is set equal to the power of the lower band excitation $u_2(n)$, which means that $$u_{HB2}(n) = u_{HB1}(n)\sqrt{\frac{\sum_{i=0}^{G3} u_2^2(k)}{\sum_{i=0}^{G3} u_{HB1}^2(k)}} \tag{4}$$

Finally the high-band excitation is found by $$u_{HB}(n)=\hat{g}_{HB}\cdot u_{HB2}(n) \tag{5}$$

where $\hat{g}_{HB}$ is a gain factor.

In the 23.85 kbit/s mode, $\hat{g}_{HB}$ is decoded from the received gain index (side information).

In the 6.60, 8.85, 12.65, 14.25, 15.85, 18.25, 19.85 and 23.05 kbit/s modes, $g_{HB}$ is estimated using voicing information bounded by [0.1, 1.0]. First, the tilt of synthesis $e_{tilt}$ is found $$e_{tilt} = \frac{\sum_{i=0}^{G3} \hat{s}_{hp}(n)\cdot\hat{s}_{hp}(n-1)}{\sum_{i=0}^{G3} \hat{s}_{hp}^2(n)} \tag{6}$$

where $\hat{s}_{hp}$ is the high-pass filtered lower band speech synthesis $\hat{s}_{hp12,8}(n)$ with cut-off frequency of 400 Hz. $g_{HB}$ is then found by $$g_{HB}=w_{SP}\cdot g_{SP}+(1-w_{SP})\cdot g_{BG} \tag{7}$$

where $g_{SP}=1-e_{tilt}$ is the gain for the speech signal, $g_{BG}=1.25\ g_{SP}$ is the gain for the background noise signal, and $w_{SP}$ is a weighting function set to 1, when voice activity detection (VAD) is ON, and 0 when VAD is OFF. $g_{HB}$ is bounded between [0.1, 1.0]. In case of voiced segments where less energy is present at high frequencies, $e_{tilt}$ approaches 1 resulting in a lower gain $g_{HB}$. This reduces the energy of the generated noise in case of voiced segments.

Then the high-band LP synthesis filter $A_{HB}(z)$ is derived from the weighted low-band LP synthesis filter:

$$A_{HB}(z) = \hat{A}\left(\frac{z}{0.8}\right) \tag{8}$$

where $\hat{A}(z)$ is the interpolated LP synthesis filter. $\hat{A}(z)$ has been computed analyzing the signal with the sampling rate of 12.8 kHz but it is now used for a 16 kHz signal. This means that the band 5.1-5.6 kHz in the 12.8 kHz domain will be mapped to 6.4-7.0 kHz in the 16 kHz domain.

$u_{HB}(n)$ is then filtered through $A_{HB}(z)$. The output of this high-band synthesis $s_{HB}(n)$ is filtered through a band-pass FIR filter $H_{HB}(z)$, which has the pass-band from 6 to 7 kHz. Finally, $s_{HB}$ is added to synthesized speech to produce the synthesized output speech signal.

In AMR-WB+ the HF signal is composed out of the frequency components above (fs/4) of the input signal. To represent the HF signal at a low rate, a bandwidth extension (BWE) approach is employed. In BWE, energy information is sent to the decoder in the form of spectral envelope and frame energy, but the fine structure of the signal is extrapolated at the decoder from the received (decoded) excitation signal in the LF signal.

The spectrum of the down sampled signal $s_{HF}$ can be seen as a folded version of the high-frequency band prior to down-sampling. An LP analysis is performed on $s_{HF}(n)$ to obtain a set of coefficients, which model the spectral envelope of this signal. Typically, fewer parameters may be used than in the LF signal. Here, a filter of order 8 is used. The LP coefficients are then transformed into ISP representation and quantized for transmission.

The synthesis of the HF signal implements a kind of bandwidth extension (BWE) mechanism and uses some data from the LF decoder. It is an evolution of the BWE mechanism used in the AMR-WB speech decoder (see above). The HF decoder is detailed in FIG. 3.

The HF signal is synthesized in 2 steps:

1. Calculation of the HF excitation;
2. Computation of the HF signal from the HF excitation.

The HF excitation is obtained by shaping the LF excitation signal in time-domain with scalar factors (or gains) on a 64-sample subframe basis. This HF excitation is post-processed to reduce the "buzziness" of the output, and then filtered by an HF linear-predictive synthesis filter $1/A_{HF}(z)$. The result is further post-processed to smooth energy variations. For further information please refer to [3GP09].

The packet-loss concealment in SBR in conjunction with AAC is specified in 3GPP TS 26.402 [3GP12a, section 5.2] and was subsequently reused in DRM [EBU12, section 5.6.3.1] and DAB [EBU10, section A2].

In case of a frame loss, the number of envelops per frame is set to one and the last valid received envelope data is reused and decreased in energy by a constant ratio for every concealed frame.

The resulting envelope data are then fed into the normal decoding process where the HF adjuster uses them to calculate the gains, which are used for adjusting the patched highbands out of the HF generator. The rest of SBR decoding takes place as usual.

Moreover, the coded noise floor delta values are being set to zero which lets the delta decoded noise floor remain static. At the end of the decoding process, this means that the energy of the noise floor follows the energy of the HF signal.

Furthermore, the flags for adding sines are cleared.

State of the art SBR concealment takes also care of recovery. It attends for a smooth transition from the concealed signal to the correctly decoded signal in terms of energy gaps that may result from mismatched frame borders.

State of the art SBR concealment in conjunction with CELP/HVXC is described in [EBU12, section 5.6.3.2] and briefly outlined in the following:

Whenever a corrupted frame has been detected, a predetermined set of data values is applied to the SBR decoder. This yields "a static highband spectral envelope at a low relative playback level, exhibiting a roll-off towards the higher frequencies." [EBU12, section 5.6.3.2]. Here, SBR concealment inserts some kind of comfort noise, which has no dedicated fading in SBR domain. This prevents the listener's ears from potentially loud audio bursts and keeps the impression of a constant bandwidth.

State of the art concealment of the BWE of G.718 is described in [ITU08, 7.11.1.7.1] and briefly outlined as follows:

In the low delay mode, which is exclusively available for layer 1 and 2, the concealment of the high-frequency band 6000-7000 Hz is performed exactly in the same way as when no frame erasures occur. The clean-channel decoder operation for layers 1, 2 and 3 is as follows: a blind bandwidth extension is applied. The spectrum in the range 6400-7000 Hz is filled up with a white noise signal, properly scaled in the excitation domain (energy of the high-band matches the low band energy). It is then synthesized with a filter derived by weighting from the same LP synthesis filter as used in the 12.8 kHz domain. For layers 4 and 5 no bandwidth extension is performed, since those layers cover the full band up to 8 kHz.

In the default operation a low complexity processing is performed to reconstruct the high-frequency band of the synthesized signal at 16 kHz sampling frequency. First, the scaled high-frequency band excitation, $u''_{HB}(n)$, is linearly attenuated throughout the frame as $$u'''_{HB}(u)=u''_{HB}(n)\cdot g_{att}(n), \text{ for } n=|0, \ldots ,319 \tag{9}$$

where the frame length is 320 samples and $g_{att}(n)$ is an attenuation factor which is given by $$g_{att}(n) = 1.0 - n\frac{1.0 - \bar{g}_p}{320}, \quad \text{for } n = 0, \ldots , 319 \tag{10}$$

In the equation above, $\bar{g}_p$ is the average pitch gain. It is the same gain as used during concealment of the adaptive codebook. Then, the memory of the band-pass filter in the frequency range 6000-7000 Hz is attenuated using $g_{att}(n)$, as derived in equation 10, to prevent any discontinuities. Finally, the high-frequency excitation signal, $u'''(n)$, is filtered through the synthesis filter. The synthesized signal is then added to the concealed synthesis at a 16 kHz sampling frequency.

State of the art concealment of blind bandwidth extension in AMR-WB is outlined in [3GP12b, 6.2.4] and briefly summarized here:

When a frame is lost or partly lost, the high-band gain parameter is not received and an estimation for the high-band gain is used instead. This means that in case of bad/lost speech frames, the high-band reconstruction operates in the same way for all the different modes.

In case a frame is lost, the high-band LP synthesis filter is derived like usual from the LPC coefficients from the core band. The only exception is that the LPC coefficients have not been decoded from the bitstream, but were extrapolated using the regular AMR-WB concealment approach.

State of the art concealment of bandwidth extension in AMR-WB+ is outlined in [3GP09, 6.2] and briefly summarized here:

In the case of a packet loss, the control data which are internal to the HF decoder are generated from the bad frame indicator vector BFI=(bfi0, bfi1, bfi2, bfi3). These data are $bfi_{isf_{hf}}$, $BFI_{GAIN}$, and the number of subframes for ISF interpolation. The nature of these data is defined in more details below:

$bfi_{isf_{hf}}$ is a binary flag indicating the loss of the ISF parameters. As the ISF parameters for the HF signal are transmitted in the first packet (containing the first subframe) being either HF20, 40 or 80, the loss flag is set to the bfi indicator of the first subframe (bfi0). The same holds true for the indication of lost HF gains. If the first packet/subframe of the current mode is lost (HF20, 40 or 80) the gain is lost and needs to be concealed.

The concealment of the HF ISF vectors is very similar to the ISF concealment for the core ISFs. The main idea is to reuse the last good ISF vector, but shift it towards the mean ISF vector (where the mean ISF vector is offline trained):

$$isf_q[i]=0.9\cdot isf_q[i]+0.1\cdot \text{mean_}isf_hf[i] \tag{11}$$

The BWE gains $(\bar{g}_0, \ldots, \bar{g}_{nb-1})$ are estimated according to the following source code (in the code: $\hat{g}_i \hat{=}$gain_q[i]; 2.807458 is a decoder constant).

```
/* use the past gains slightly shifted towards the means */
*past_q = (0.9f*(*past_q + 20.0f)) - 20.0f;
for (i=0; i<4; i++) {
   gain_q[i] = *past_q + 2.807458f;
}
tmp = 0.0;
for (i=0; i<4; i++) {
   tmp += gain_q[i];
}
*past_q = 0.25f*tmp - 2.807458f;
```

In order to derive the "gains to match the magnitude at fs/4" the same algorithm as in clean channel decoding is performed, but with the exception that the ISFs for the HF and/or the LF part may already be concealed. All following steps like linear!dB interpolation, summation and application of gains are the same as in the clean channel case.

To derive the excitation, the same procedure is applied as in a correctly received frame, where the lower band excitation is used after:

it was randomized it was amplified in the time-domain with subframe gains it was shaped in the frequency domain with an LP filter the energy was smoothed over time Then the synthesis is performed according to FIG. 3.

AES convention paper 6789: Schneider, Krauss and Ehret [SKE06] describe a concealment technique which reuses the last valid SBR envelope data. If more than one SBR frame is lost, a fadeout is applied. "The basic principle is to simply lock the last known valid SBR envelope values until SBR processing may be continued with newly transmitted data. In addition a fade-out is performed if more than one SBR frame is not decodable."

AES convention paper 6962: Sang-Uk Ryu and Kenneth Rose [RR06] describe a concealment technique which estimates the parametric information, utilizing SBR data from the previous and the next frame. High band envelopes are adaptively estimated from energy evolution in the surrounding frames.

The packet-loss concealment concepts may produce a perceptually degraded audio signal during packet loss.

SUMMARY

According to an embodiment, an audio decoder configured to produce an audio signal from a bitstream containing audio frames may have: a core band decoding module configured to derive a directly decoded core band audio signal from the bitstream; a bandwidth extension module configured to derive a parametrically decoded bandwidth extension audio signal from the core band audio signal and from the bitstream, wherein the bandwidth extension audio signal is based on a frequency domain signal having at least one frequency band; and a combiner configured to combine the core band audio signal and the bandwidth extension audio signal so as to produce the audio signal; wherein the bandwidth extension module includes an energy adjusting module being configured in such way that in a current audio frame in which an audio frame loss occurs, an adjusted signal energy for the current audio frame for the at least one frequency band is set based on a current gain factor for the current audio frame, wherein the current gain factor is derived from a gain factor from a previous audio frame or from the bitstream, and based on an estimated signal energy for the at least one frequency band, wherein the estimated signal energy is derived from a spectrum of the current audio frame of the core band audio signal.

According to another embodiment, a method for producing an audio signal from a bitstream containing audio frames may have the steps of: deriving a directly decoded core band audio signal from the bitstream; deriving a parametrically decoded bandwidth extension audio signal from the core band audio signal and from the bitstream, wherein the bandwidth extension audio signal is based on a frequency domain signal having at least one frequency band; and combining the core band audio signal and the bandwidth extension audio signal so as to produce the audio signal; wherein in a current audio frame in which an audio frame loss occurs, an adjusted signal energy for the current audio frame for the at least one frequency band is set based on a current gain factor for the current audio frame, wherein the current gain factor is derived from a gain factor from a previous audio frame or from the bitstream, and based on an estimated signal energy for the at least one frequency band, wherein the estimated signal energy is derived from a spectrum of the current audio frame of the core band audio signal.

Another embodiment may have a computer program for performing, when running on a computer or a processor, the method of claim 14.

The audio decoder according to the invention links the bandwidth extension module to the core band decoding module in terms of energy or, in other words, assures that the bandwidth extension module follows the core band decoding module energy-wise during concealment, no matter what the core band decoding module does.

The innovation with this approach is that—in concealment case—the high band generation is not strictly adapted to envelope energies anymore. With the technique of gain locking, the high band energies are adapted to the low band energies during concealment and hence are no more relying only on the transmitted data in the last good frame. This proceeding takes up the idea to use low band information for high band reconstruction.

With this approach, no additional data (e.g. fadeout factor) needs to be transferred from the core coder to the bandwidth extension coder. This makes the technique easily applicable to any coder with bandwidth extension, especially to SBR, where gain calculation already is performed inherently (equation 1).

The concealment of the inventive audio decoder takes into consideration the fading slope of the core band decoding module. This leads to intended behavior of the fadeout as a whole:

Situations in which the energies of the frequency bands of the core band decoding module fade out slower than the energies of the frequency bands of the bandwidth extension module, which would become perceivable and cause the unlovely impression of a band limited signal, are avoided.

Furthermore, situations in which the energies in the frequency bands of the core band decoding module fade out faster than the energies of the frequency bands of the bandwidth extension module, which would introduce artifacts because frequency bands of the bandwidth extension module are amplified too much, compared to the frequency bands of the core band decoding module, are avoided as well.

In contrast to a non-fading decoder having a bandwidth extension with predefined energy levels (as for example a CELP/HVXC+SBR decoder), which preserves only the spectral tilt of a certain signal type, works the inventive audio decoder independently from the spectral characteristics of the signals, so that a perceptually decoded degradation of the audio signal is avoided.

The proposed technique could be used with any bandwidth extension (BWE) method on top of a core band decoding module (core coder in the following). Most of the bandwidth extension technique is based on the gain per band between the original energy levels and the energy levels obtained after copying the core spectrum. The proposed technique does not work on the energies of the previous audio frame, as the state of the art does, but on the gains of the previous audio frame.

When an audio frame is lost or unreadable (or in other words, if an audio frame loss occurs) the gains from the last good frame are fed into the normal decoding process of the core band decoding module, which adjusts the energies of the frequency bands of the bandwidth extension module (see equation 1). This forms the concealment. Any fadeout, being applied on the core band decoding module by a core band decoding module concealment, will be automatically applied to the energies of the frequency bands of the bandwidth extension module by locking the energy ratio between the low and the high band.

The frequency domain signal having at least one frequency band may be, for example, an algebraic code-excited linear prediction excitation signal (ACELP excitation signal).

In some embodiments the bandwidth extension module comprises gain factor providing module configured to forward the current gain factor at least in the current audio frame in which the audio frame loss occurs to the energy adjusting module.

In an advantageous embodiment the gain factor providing module is configured in such way that in the current audio frame in which the audio frame loss occurs the current gain factor is the gain factor of the previous audio frame.

This embodiment completely deactivates the fadeout contained in the bandwidth extension decoding module by only locking the gains derived for the last envelope in the last good frame:

$$g_{bwe}^{[n]}[k]=g_{bwe}^{[n-1]}[k]$$

$$E_{Adj}[k]=E_{Est}[k]*_{bwe}[k] \tag{12}$$

wherein $E_{Adj}[k]$ denotes the energy from one frequency band k of the bandwidth extension module, adjusted to express the original energy distribution as good as possible; $g_{bwe}^{[n]}[k]$, $g_{bwe}[k]$ denotes the gain factor of the current frame; and $g_{bwe}^{[n-1]}[k]$ denotes the gain factor of the previous frame.

In another advantageous embodiment the gain factor providing module is configured in such way that in the current audio frame in which the frame loss occurs the current gain factor is calculated from the gain factor of the previous audio frame and from a signal class of the previous audio frame.

This embodiment uses a signal classifier to compute the gains based on the past gains and also adaptively on the signal class of the previously received frame:

$$g_{bwe}^{[n]}[k]=f(g_{bwe}^{[n-1]}[k],c_{sig}^{[n|-1]})$$

$$E_{Adj}[k]=E_{Est}[k]*g_{bwe}[k] \tag{13}$$

wherein $f(g_{bwe}^{[n-1]},c_{sig}^{[n-1]})$ denotes a function, depending on the gain factor $g_{bwe}^{[n-1]}$ the previous audio frame and the signal class $c_{sig}^{[n-1]}$ of the previous audio frame. Signal classes may refer to classes of speech sounds such as: obstruent (with subclasses: stop, affricative, fricative), sonorant (this subclasses: nasal, flap approximant, vowel), lateral, trill.

In an advantageous embodiment the gain factor providing module is configured to calculate a number of subsequent audio frames in which audio frame losses occur and configured to execute a gain factor lowering procedure in case the number of subsequent audio frames in which audio frame losses occur exceeds a predefined number.

If a fricative occurs immediately before a burst frame loss (multiple frame losses in subsequent audio frames), the inherent default fadeout of the core band decoding module may be too slow to assure a pleasant and natural sound in combination with gain locking. The perceived result of this issue may be a prolonged fricative with too much energy in the frequency bands of the bandwidth extension module. For this reason a check for multiple frame losses may be performed. If this check is positive a gain factor lowering procedure may be executed.

In an advantageous embodiment the gain factor lowering procedure comprises the step of lowering the current gain factor by dividing the current gain factor by a first figure in case the current gain factor exceeds a first threshold. By these features on gains that exceed a the first threshold (which may be determined empirically) are lowered.

In an advantageous embodiment the gain factor lowering procedure comprises the step of lowering the current gain factor by dividing the current gain factor by a second figure which is large than the first figure in case the current gain factor exceeds a second threshold which is larger than the first threshold. These features ensure that extremely high gains decrease even faster. All gains exceeding the second threshold will be decreased faster.

In some embodiments the gain factor lowering procedure comprises the step of setting the current gain factor to the first threshold in case the current threshold after lowering is below the first threshold. By these features the decreased gains are prevented to fall below the first threshold.

An example can be seen within the pseudo code 1:

```
/*limit gain in case of multiple frameloss*/
#DEFINE BWE_GAINDEC 10
if (previousFrameErrorFlag && (gain[k] > BWE_GAINDEC) ) {
  /* gains exceeding the first threshold 50 times will be decreased faster
*/
  if (gain[k] > 50* BWE_GAINDEC ) {
    gain[k] /= 6;
  }
  else {
    gain[k] /= 4;
  }
  /* prevent gains from falling below BWE_GAINDEC */
  if (gain[k] < BWE_GAINDEC) {
    gain[k] = BWE_GAINDEC;
  }
}
```

wherein previousFrameErrorFlag is a flag, which indicates if a multiple frame loss is present, BWE_GAINDEC denotes the first threshold, 50*BWE_GAINDEC denotes the second threshold and gain[k] denotes the current gain factor for the frequency band k.

In some embodiments the bandwidth extension module comprises a noise generator module configured to add noise to the at least one frequency band, wherein in the current audio frame in which the audio frame loss occurs a ratio of the signal energy to the noise energy of the at least one frequency band of the previous audio frame is used to calculate the noise energy of the current audio frame.

In case there is a noisefloor feature (i.e. additional noise components to retain noisiness of the original signal) implemented in the bandwidth extension, it is useful to adopt the idea of gain locking also towards the noise floor. To achieve this, the noise floor energy levels of non-concealed frames are converted to a noise ratio, taking into account the energy of the frequency bands of the bandwidth extension module. The ratio is saved to a buffer and will be the base for the noise level in the concealment case. The main advantage is the better coupling of the noise floor to the core coder energy due to a calculation of the ratio prev_noise[k].

The pseudo code 2 shows this:

```
for (k=bands) {
  if !(frameErrorFlag) {
    prev_noise[k] = nrgHighband[k] / noiseLevel[k];
  }
  else {
    noiseLevel[k] = nrgHighband[k] / prev_noise[k];
  }
}
```

wherein frameErrorFlag is a flag indicating if a frame loss is present and prev_noise[k] is the ratio between the energy nrgHighband[k] of the frequency band k and the noise level noiseLevel[k] of the frequency band k.

In an advantageous embodiment the audio decoder comprises a spectrum analyzing module configured to establish the spectrum of the current audio frame of the core band audio signal and to derive the estimated signal energy for the current frame for the at least one frequency band from the spectrum of the current audio frame of the core band audio signal.

In some embodiments the gain factor providing module is configured in such way that, in case that a current audio frame, in which an audio frame loss does not occur, subsequently follows on a previous audio frame, in which an audio frame loss occurs, the gain factor received for the current audio frame is used for the current frame, if a delay between audio frames of the bandwidth extension module with respect to the audio frames of the core band decoding module is smaller than a delay threshold, whereas the gain factor from the previous audio frame is used for the current frame, if the delay between audio frames of the bandwidth extension module with respect to the audio frames of the core band decoding module is bigger than the delay threshold.

On top of the concealment, in the bandwidth extension module special attention needs to be paid to the framing. Audio frames of the bandwidth extension module and audio frames of the core band decoding module are often not exactly aligned but could have a certain delay. So it may happen that one lost packet contains bandwidth extension data being delayed, relative to the core signal contained in the same packet.

The result in this case is that the first good packet after a loss may contain extension data to create parts of the frequency bands of the bandwidth extension module of the previous core band decoding module audio frame, which was already concealed in the decoder.

For this reason, the framing needs to be considered during recovery, depending on the respective properties of the core and decoding module and bandwidth extension module. This could mean to treat the first audio frame or parts of it in the bandwidth extension module as erroneous and not to apply the newest gains at once but to keep the locked gains from the first audio frame for one additional frame.

Whether or not to keep the locked gains for the first good frame depends on the delay. Experimental application to codecs with different delays showed different benefit for codecs with different delays. For codecs with quite small delays (e.g. 1 ms), it is better to use the newest gains for the first good audio frame.

In an advantageous embodiment the bandwidth extension module comprises a signal generator module configured to create a raw frequency domain signal having at least on frequency band, which is forwarded to the energy adjusting module, based on the core band audio signal and the bitstream.

In an advantageous embodiment the bandwidth extension module comprises a signal synthesis module configured to produce the bandwidth extension audio signal from the frequency domain signal.

The object of the invention may be achieved by a method for producing an audio signal from a bitstream containing audio frames. The method comprises the steps of:

deriving a directly decoded core band audio signal from the bitstream, deriving a parametrically decoded bandwidth extension audio signal from the core band audio signal and from the bitstream, wherein the bandwidth extension audio signal is based on a frequency domain signal having at least one frequency band; and combining the core band audio signal and the bandwidth extension audio signal so as to produce the audio signal;

wherein in a current audio frame in which an audio frame loss occurs, an adjusted signal energy for the current audio frame for the at least one frequency band is set based on a current gain factor for the current audio frame, wherein the current gain factor is derived from a gain factor from a previous audio frame or from the bitstream, and based on an estimated signal energy for the at least one frequency band, wherein the estimated signal energy is derived from a spectrum of the current audio frame of the core band audio signal.

The object of the invention may further be achieved by a computer program for performing, when running on a computer or a processor, the method described above.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
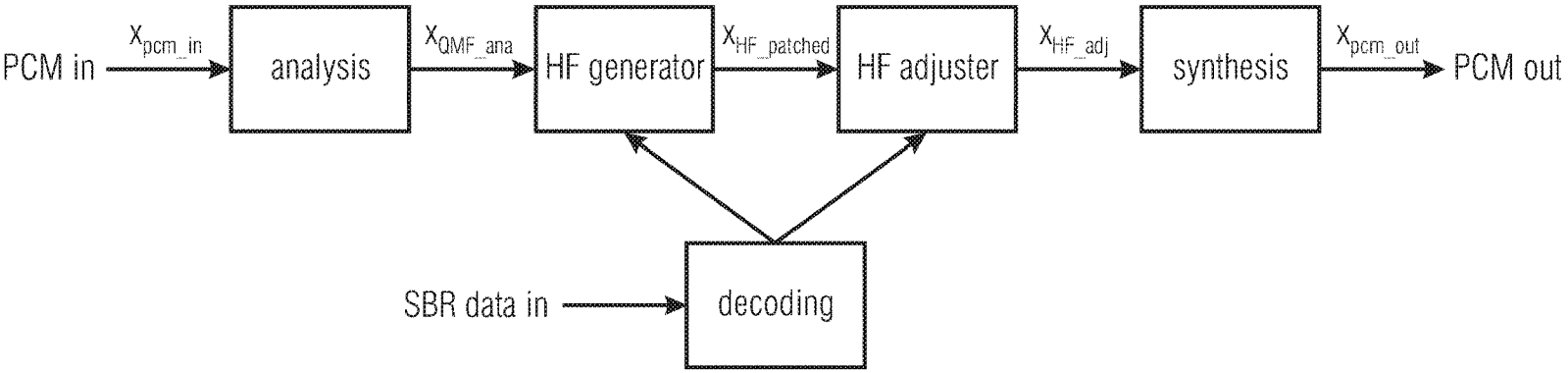
FIG 1 PRIOR ART
FIG. 1 illustrates a state of the art SBR decoder which comprises an analysis and a synthesis filterbank, an SBR data decoding, an HF generator and an HF adjuster.
Figure 2:
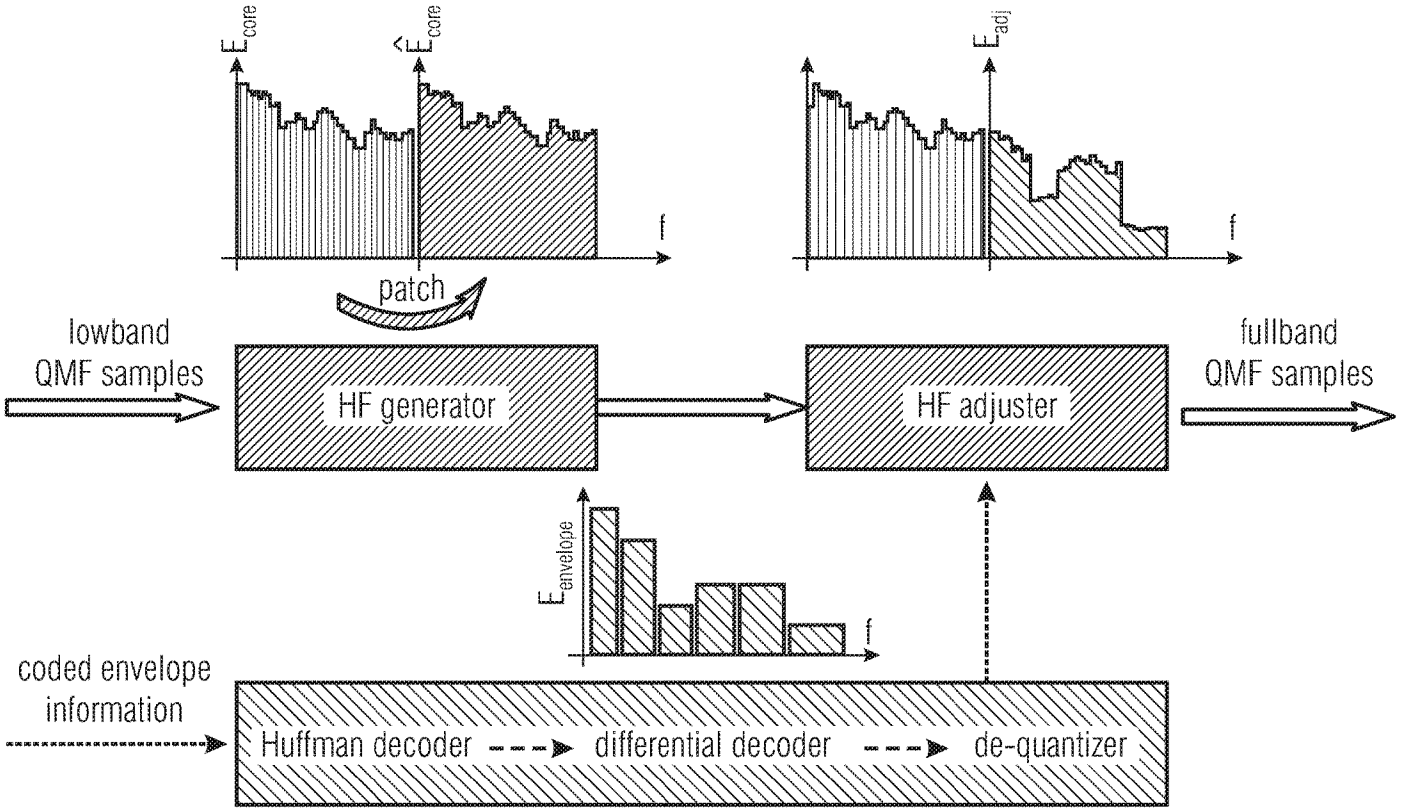
FIG 2 PRIOR ART
FIG. 2 illustrates a state of the art SBR decoding scheme.
Figure 3:
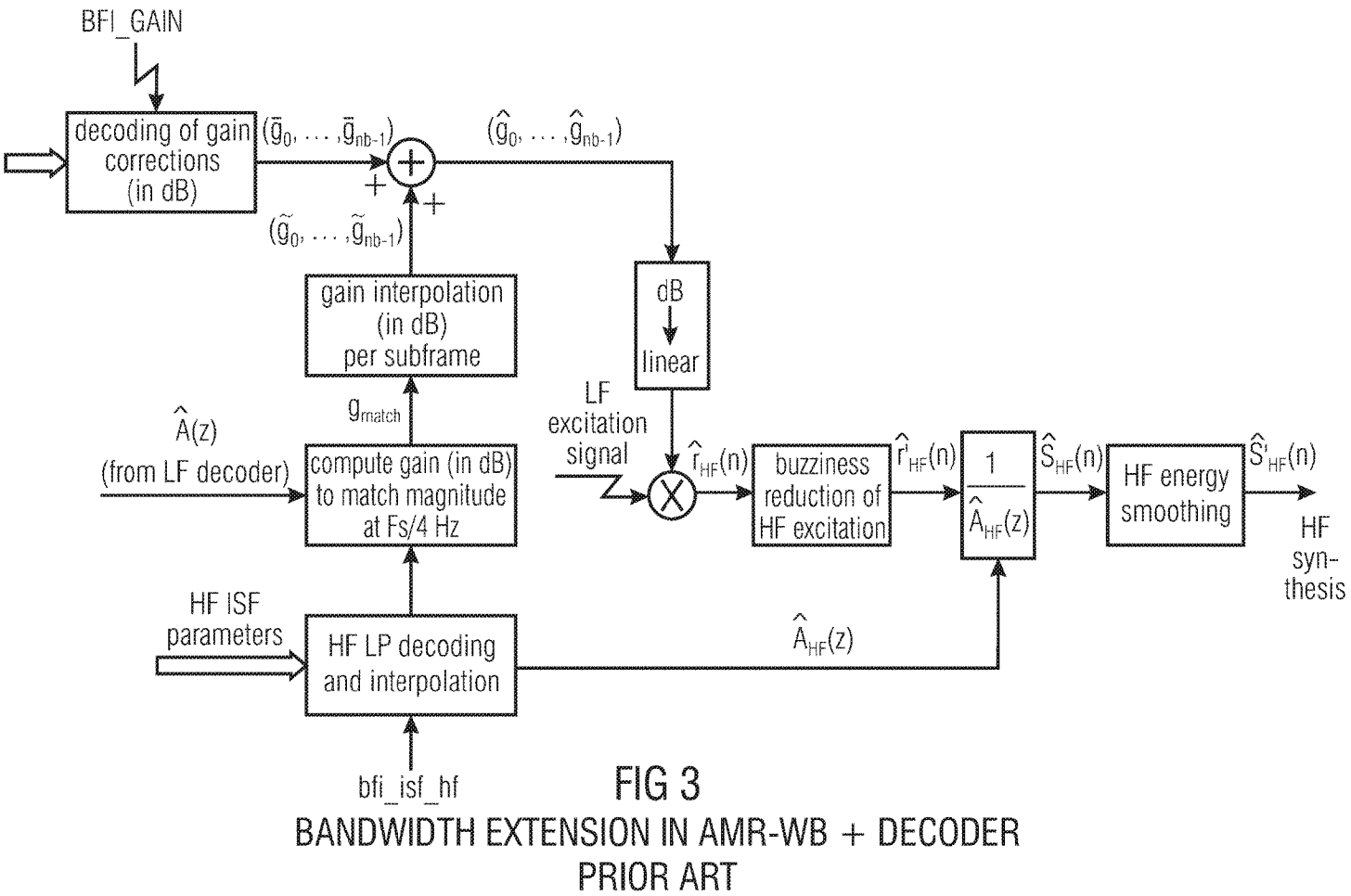
FIG. 3 illustrates a state of the art bandwidth extension scheme.
Figure 4:
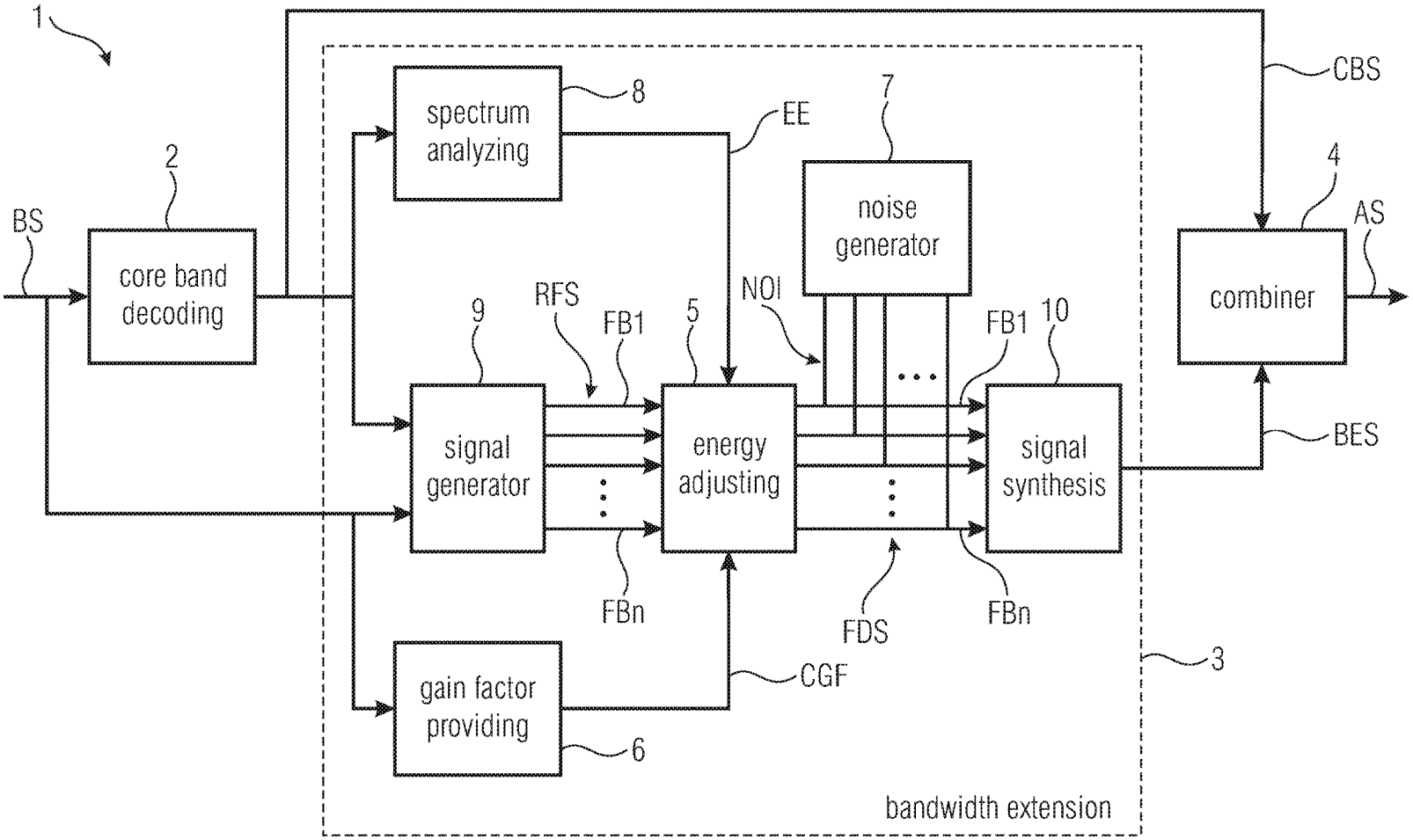
FIG. 4 illustrates an embodiment of an audio decoder according to the invention in a schematic view.

FIG. 4 illustrates an embodiment of an audio decoder 1 according to the invention in a schematic view. The audio decoder 1 is configured to produce an audio signal AS from a bitstream BS containing audio frames AF. The audio decoder 1 comprises:

a core band decoding module to configured to derive a directly decoded core band audio signal CBS from the bitstream BS;

a bandwidth extension module 2 configured to derive a parametrically decoded bandwidth extension audio signal BES from the core band audio signal CBS and from the bitstream BS, wherein the bandwidth extension audio signal BES is based on a frequency domain signal FDS having at least one frequency band FB, and a combiner 4 configured to combine the core band audio signal CBS and the bandwidth extension audio signal BES so as to produce the audio signal AS;

wherein the bandwidth extension module 3 comprises an energy adjusting module 5 being configured in such way that in a current audio frame AF2 in which an audio frame loss AFL occurs, an adjusted signal energy for the current audio frame AF2 for the at least one frequency band FB is set based on a current gain factor CGF for the current audio frame AF2, wherein the current gain factor CGF is derived from a gain factor from a previous audio frame AF1 or from the bitstream BS, and based on an estimated signal energy EE for the at least one frequency band FB, wherein the estimated signal energy EE is derived from a spectrum of the current audio frame AF2 of the core band audio signal CBS.

The audio decoder 1 according to the invention links the bandwidth extension module 3 to the core band decoding module to in terms of energy or, in other words, assures that the bandwidth extension module 3 follows the core band decoding module 2 energy-wise during concealment, no matter what the core band decoding module 2 does.

The innovation with this approach is that—in concealment case—the high band generation is not strictly adapted to envelope energies anymore. With the technique of gain locking, the high band energies are adapted to the low band energies during concealment and hence are no more relying only on the transmitted data in the last good frame AF1. This proceeding takes up the idea to use low band information for high band reconstruction.

With this approach, no additional data (e.g. fadeout factor) needs to be transferred from the core coder 2 to the bandwidth extension coder 3. This makes the technique easily applicable to any coder 1 with bandwidth extension 3, especially to SBR, where gain calculation already is performed inherently (equation 1).

The concealment of the inventive audio decoder 1 takes into consideration the fading slope of the core band decoding module 2. This leads to intended behavior of the fadeout as a whole:

Situations in which the energies of the frequency bands FB of the core band decoding module 2 fade out slower than the energies of the frequency bands FB of the bandwidth extension module 3, which would become perceivable and cause the unlovely impression of a band limited signal, are avoided.

Furthermore, situations in which the energies in the frequency bands FB of the core band decoding module 2 fade out faster than the energies of the frequency bands FB of the bandwidth extension module 3, which would introduce artifacts because frequency bands FB of the bandwidth extension module 3 are amplified too much, compared to the frequency bands FB of the core band decoding module 2, are avoided as well.

In contrast to a non-fading decoder having a bandwidth extension with predefined energy levels (as for example a CELP/HVXC+SBR decoder), which preserves only the spectral tilt of a certain signal type, the inventive audio decoder 1 works independently from the spectral characteristics of the signals, so that a perceptually decoded degradation of the audio signal AS is avoided.

The proposed technique could be used with any bandwidth extension (BWE) method on top of a core band decoding module 2 (core coder in the following). Most of the bandwidth extension technique is based on the gain per band between the original energy levels and the energy levels obtained after copying the core spectrum. The proposed technique does not work on the energies of the previous audio frame, as the state of the art does, but on the gains of the previous audio frame AF1.

When an audio frame AF2 is lost or unreadable (or in other words, if an audio frame loss AFL occurs) the gains from the last good frame are fed into the normal decoding process of the core band decoding module 2, which adjusts the energies of the frequency bands FB of the bandwidth extension module 3 (see equation 1). This forms the concealment. Any fadeout, being applied on the core band decoding module 2 by a core band decoding module concealment, will be automatically applied to the energies of the frequency bands FB of the bandwidth extension module 3 by locking the energy ratio between the low and the high band.

In some embodiments the bandwidth extension module 3 comprises gain factor providing module 6 configured to forward the current gain factor CGF at least in the current audio frame AF2 in which the audio frame loss AFL occurs to the energy adjusting module 5.

In an advantageous embodiment the gain factor providing module 6 is configured in such way that in the current audio frame AF2 in which the audio frame loss AFL occurs the current gain factor CGF is the gain factor of the previous audio frame AF1.

This embodiment completely deactivates the fadeout contained in the bandwidth extension decoding module 3 by only locking the gains derived for the last envelope in the last good frame:

In another advantageous embodiment the gain factor providing module 6 is configured in such way that in the current audio frame AF2 in which the frame loss AFL occurs the current gain factor she CGS is calculated from the gain factor of the previous audio frame and from a signal class of the previous audio frame.

This embodiment uses a signal classifier to compute the gains GCS based on the past gains and also adaptively on the signal class of the previously received frame AF1. Signal classes may refer to classes of speech sounds such as: obstruent (with subclasses: stop, affricative, fricative), sonorant (this subclasses: nasal, flap approximant, vowel), lateral, trill.

In an advantageous embodiment the gain factor providing module 6 is configured to calculate a number of subsequent audio frames in which audio frame losses AFL occur and configured to execute a gain factor lowering procedure in case the number of subsequent audio frames in which audio frame losses AFL occur exceeds a predefined number.

If a fricative occurs immediately before a burst frame loss (multiple frame losses AFL in subsequent audio frames AF), the inherent default fadeout of the core band decoding module 2 may be too slow to assure a pleasant and natural sound in combination with gain locking. The perceived result of this issue may be a prolonged fricative with too much energy in the frequency bands FB of the bandwidth extension module 3. For this reason a check for multiple frame losses AFL may be performed. If this check is positive a gain factor lowering procedure may be executed.

In an advantageous embodiment the gain factor lowering procedure comprises the step of lowering the current gain factor by dividing the current gain factor by a first figure in case the current gain factor exceeds a first threshold. By these features on gains that exceed the first threshold (which may be determined empirically) are lowered.

In an advantageous embodiment the gain factor lowering procedure comprises the step of lowering the current gain factor by dividing the current gain factor by a second figure which is large than the first figure in case the current gain factor exceeds a second threshold which is larger than the first threshold. These features ensure that extremely high gains decrease even faster. All gains exceeding the second threshold will be decreased faster.

In some embodiments the gain factor lowering procedure comprises the step of setting the current gain factor to the first threshold in case the current threshold after lowering is below the first threshold. By these features the decreased gains are prevented to fall below the first threshold.

In some embodiments the bandwidth extension module 3 comprises a noise generator module 7 configured to add noise NOI to the at least one frequency band FB, wherein in the current audio frame AF2 in which the audio frame loss AFL occurs a ratio of the signal energy to the noise energy of the at least one frequency band FB of the previous audio frame AF1 is used to calculate the noise energy of the current audio frame AF2.

In case there is a noisefloor feature (i.e. additional noise components to retain noisiness of the original signal) implemented in the bandwidth extension 3, it is useful to adopt the idea of gain locking also towards the noise floor. To achieve this, the noise floor energy levels of non-concealed frames are converted to a noise ratio, taking into account the energy of the frequency bands of the bandwidth extension module. The ratio is saved to a buffer and will be the base for the noise level in the concealment case. The main advantage is the better coupling of the noise floor to the core coder energy due to a calculation of the ratio.

In an advantageous embodiment the audio decoder 1 comprises a spectrum analyzing module 8 configured to establish the spectrum of the current audio frame AF2 of the core band audio signal CBS and to derive the estimated signal energy EE for the current frame AF2 for the at least one frequency band FB from the spectrum of the current audio frame AF2 of the core band audio signal CBS.

In an advantageous embodiment the bandwidth extension module 3 comprises a signal generator module 9 configured to create a raw frequency domain signal RFS having at least on frequency band FB, which is forwarded to the energy adjusting module 5, based on the core band audio signal CBS and the bitstream BS.

In an advantageous embodiment the bandwidth extension module 3 comprises a signal synthesis module 10 configured to produce the bandwidth extension audio signal BES from the frequency domain signal FDS.

Figure 5:
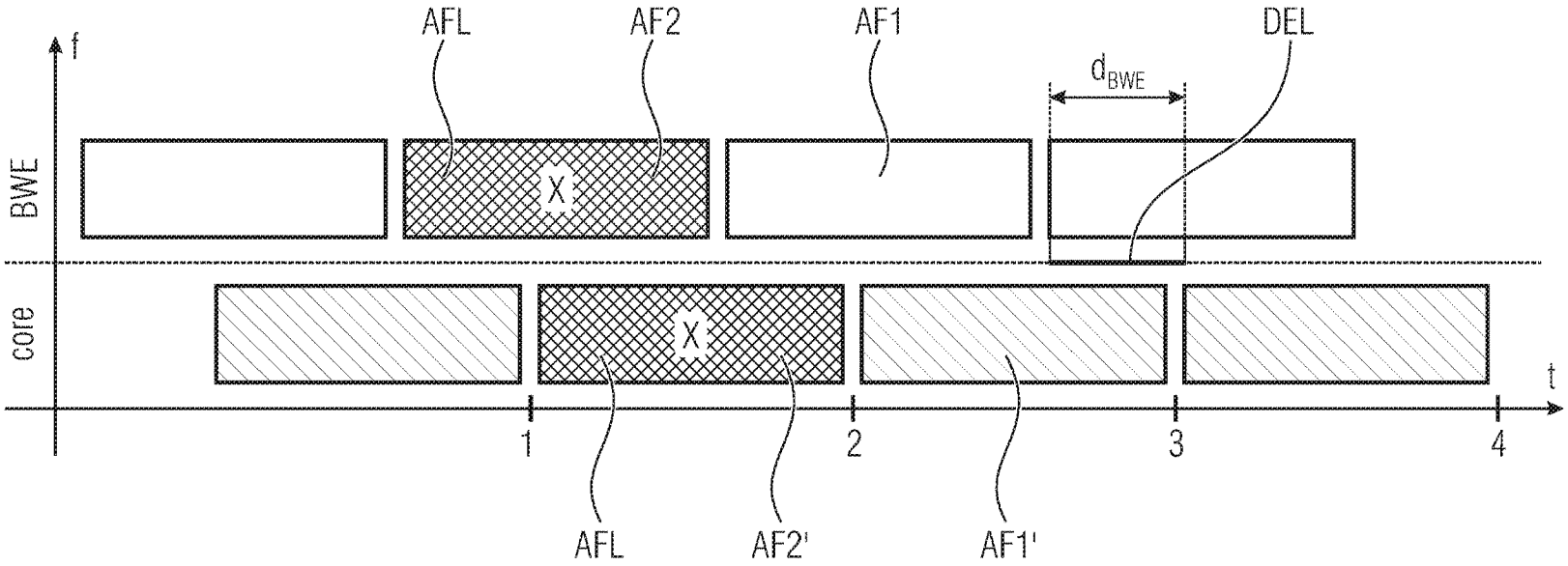
FIG. 5 illustrates the framing of an embodiment of an audio decoder according to the invention.

FIG. 5 illustrates the framing of an embodiment of an audio decoder 1 according to the invention.

In some embodiments the gain factor providing module 6 is configured in such way that, in case that a current audio frame AF2, in which an audio frame loss AFL does not occur, subsequently follows on a previous audio frame AF1, in which an audio frame loss AFL occurs, the gain factor received for the current audio frame AF2 is used for the current frame AF2, if a delay DEL between audio frames AF of the bandwidth extension module 3 with respect to the audio frames AF' of the core band decoding module 2 is smaller than a delay threshold, whereas the gain factor from the previous audio frame AF1 is used for the current frame AF 2, if the delay DEL between audio frames AF of the bandwidth extension module 3 with respect to the audio frames AF' of the core band decoding module 3 is bigger than the delay threshold.

On top of the concealment, in the bandwidth extension module 3 special attention needs to be paid to the framing. Audio frames AF of the bandwidth extension module and audio frames AF' of the core band decoding module 3 are often not exactly aligned but could have a certain delay DEL. So it may happen that one lost packet contains bandwidth extension data being delayed, relative to the core signal contained in the same packet.

The result in this case is that the first good packet after a loss may contain extension data to create parts of the frequency bands FB of the bandwidth extension module 3 of the previous core band decoding module audio frame AF', which was already concealed in the decoder 2.

For this reason, the framing needs to be considered during recovery, depending on the respective properties of the core decoding module and bandwidth extension module. This could mean to treat the first audio frame or parts of it in the bandwidth extension module 3 as erroneous and not to apply the newest gain factor at once but to keep the locked gains from the first audio frame for one additional frame.

Whether or not to keep the locked gains for the first good frame depends on the delay. Experimental application to codecs with different delays showed different benefit for codecs with different delays. For codecs with quite small delays (e.g. 1 ms), it is better to use the newest gain factors for the first good audio frame.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[3GP09] 3GPP; Technical Specification Group Services and System Aspects, Extended adaptive multi-rate—wideband (AMR-WB+) codec, 3GPP TS 26.290, 3rd Generation Partnership Project, 2009.

[3GP12a] General audio codec audio processing functions; Enhanced aac-Plus general audio codec; additional decoder tools (release 11), 3GPP TS 26.402, 3rd Generation Partnership Project, September 2012.

[3GP12b] Speech codec speech processing functions; adaptive multi-rate—wideband (AMRWB) speech codec; error concealment of erroneous or lost frames, 3GPP TS 26.191, 3rd Generation Partnership Project, September 2012.

[EBU10] EBU/ETSI JTC Broadcast, Digital audio broadcasting (DAB); transport of advanced audio coding (AAC) audio, ETSI TS 102 563, European Broadcasting Union, May 2010.

[EBU12] Digital radio mondiale (DRM); system specification, ETSI ES 201 980, ETSI, June 2012.

[ISO09] ISO/IEC JTC1/SC29/WG11, Information technology—coding of audio-visual objects—part 3: Audio, ISO/IEC IS 14496-3, International Organization for Standardization, 2009.

[ITU-T08] ITU-T, G.718: Frame error robust narrow-band and wideband embedded variable bit-rate coding of speech and audio from 8-32 kbit/s, Recommendation ITU-T G.718, Telecommunication Standardization Sector of ITU, June 2008.

[RR06] Sang-Uk Ryu and Kenneth Rose, Frame loss concealment for audio decoders employing spectral band replication, Convention Paper 6962, Electrical and Computer Engineering, University of California, October 2006, AES.

[SKE06] Andreas Schneider, Kurt Krauss, and Andreas Ehret, Evaluation of real-time transport protocol configurations using aacplus, Convention paper 6789, AES, May 2006, Presented at the 120th Convention 2006 May 20-23.

The invention claimed is:

1. An audio decoder configured to produce an audio signal from a bitstream comprising audio frames, the audio decoder comprising:

a core band decoding module configured to derive a directly decoded core band audio signal from the bitstream;

a bandwidth extension module configured to derive a parametrically decoded bandwidth extension audio signal from the core band audio signal and from the bitstream, wherein the bandwidth extension audio signal is based on a frequency domain signal comprising at least one frequency band; and a combiner configured to combine the core band audio signal and the bandwidth extension audio signal so as to produce the audio signal;

wherein the bandwidth extension module comprises an energy adjusting module being configured in such way that in a current audio frame in which an audio frame loss occurs, an adjusted signal energy for the current audio frame for the at least one frequency band is set based on a current gain factor for the current audio frame, wherein the current gain factor is derived from a gain factor from a previous audio frame or from the bitstream, and based on an estimated signal energy for the at least one frequency band, wherein the estimated signal energy is derived from a spectrum of the current audio frame of the core band audio signal.

2. The audio decoder according to claim 1, wherein the bandwidth extension module comprises gain factor providing module configured to forward the current gain factor at least in the current audio frame in which the audio frame loss occurs to the energy adjusting module.

3. The audio decoder according to claim 2, wherein the gain factor providing module is configured in such way that in the current audio frame in which the audio frame loss occurs the current gain factor is the gain factor of the previous audio frame.

4. The audio decoder according to claim 2 or 3, wherein the gain factor providing module is configured in such way that in the current audio frame in which the frame loss occurs the current gain factor is calculated from the gain factor of the previous audio frame and from a signal class of the previous audio frame.

5. The audio decoder according to claim 2, wherein the gain factor providing module is configured to calculate a number of subsequent audio frames in which audio frame losses occur and configured to execute a gain factor lowering procedure in case the number of subsequent audio frames in which audio frame losses occur exceeds a predefined number.

6. The audio decoder according to claim 5, wherein the gain factor lowering procedure comprises lowering the current gain factor by dividing the current gain factor by a first figure in case the current gain factor exceeds a first threshold.

7. The audio decoder according to claim 5, wherein the gain factor lowering procedure comprises lowering the current gain factor by dividing the current gain factor by a second figure which is larger than the first figure in case the current gain factor exceeds a second threshold which is larger than the first threshold.

8. The audio decoder according to claim 5, wherein the gain factor lowering procedure comprises setting the current gain factor to the first threshold in case the current threshold after lowering is below the first threshold.

9. The audio decoder according to claim 1, wherein the bandwidth extension module comprises a noise generator module configured to add noise to the at least one frequency band, wherein in the current audio frame in which the audio frame loss occurs a ratio of the signal energy to the noise energy of the at least one frequency band of the previous audio frame is used to calculate the noise energy of the current audio frame.

10. The audio decoder according to claim 1, wherein the audio decoder comprises a spectrum analyzing module configured to establish the spectrum of the current audio frame of the core band audio signal and to derive the estimated signal energy for the current frame for the at least one frequency band from the spectrum of the current audio frame of the core band audio signal.

11. The audio decoder according to claim 2, wherein the gain factor providing module is configured in such way that, in case, that a current audio frame, in which an audio frame loss does not occur, subsequently follows on a previous audio frame, in which an audio frame loss occurs, the gain factor received for the current audio frame is used for the current frame, if a delay between audio frames of the bandwidth extension module with respect to the audio frames of the core band decoding module is smaller than a delay threshold, whereas the gain factor from the previous audio frame is used for the current frame, if the delay between audio frames of the bandwidth extension module with respect to the audio frames of the core band decoding module is bigger than the delay threshold.

12. The audio decoder according to claim 1, wherein the bandwidth extension module comprises a signal generator module configured to create a raw frequency domain signal comprising at least one frequency band, which is forwarded to the energy adjusting module, based on the core band audio signal and the bitstream.

13. The audio decoder according to claim 1, wherein the bandwidth extension module comprises a signal synthesis module configured to produce the bandwidth extension audio signal from the frequency domain signal.

14. A method for producing an audio signal from a bitstream comprising audio frames, the method comprising:

deriving a directly decoded core band audio signal from the bitstream;

deriving a parametrically decoded bandwidth extension audio signal from the core band audio signal and from the bitstream, wherein the bandwidth extension audio signal is based on a frequency domain signal comprising at least one frequency band; and combining the core band audio signal and the bandwidth extension audio signal so as to produce the audio signal;

wherein in a current audio frame in which an audio frame loss occurs, an adjusted signal energy for the current audio frame for the at least one frequency band is set based on a current gain factor for the current audio frame, wherein the current gain factor is derived from a gain factor from a previous audio frame or from the bitstream, and based on an estimated signal energy for the at least one frequency band, wherein the estimated signal energy is derived from a spectrum of the current audio frame of the core band audio signal.

15. A computer readable memory device comprising a computer program for performing, when running on a computer or a processor, the method of claim 14.

* * * * *